United States Patent [19]

Asleson

[11] Patent Number: 4,889,232

[45] Date of Patent: Dec. 26, 1989

[54] STORAGE DEVICE FOR SHEETS OF SANDPAPER

[76] Inventor: Allan E. Asleson, 2107 St. Augustine Cir., Petaluma, Calif. 94952

[21] Appl. No.: 329,559

[22] Filed: Mar. 27, 1989

[51] Int. Cl.[4] ..... B65D 25/06; B65D 25/10

[52] U.S. Cl. ..... 206/449; 206/425; 220/22.1

[58] Field of Search ..... 206/449, 425; 220/22, 220/22.1, 20, 22.3; 217/7-10

[56] References Cited

U.S. PATENT DOCUMENTS

| | | | |
|---|---|---|---|
| 271,007 | 1/1883 | Wiesbauer | 217/7 |
| 418,507 | 12/1889 | Dowe | 217/7 |
| 2,221,024 | 11/1940 | Hood | 220/22.3 |
| 2,678,045 | 5/1954 | Erhard | 220/22.1 |
| 4,436,215 | 3/1984 | Kleinert | 220/22.3 |
| 4,545,484 | 10/1985 | Rohner | 206/425 |
| 4,695,103 | 9/1987 | MacDonald et al. | 206/425 X |
| 4,779,752 | 10/1988 | Vallee et al. | 220/22.1 |
| 4,782,942 | 11/1988 | Ashley et al. | 220/22.3 X |

FOREIGN PATENT DOCUMENTS

| | | | |
|---|---|---|---|
| 1154956 | 9/1963 | Fed. Rep. of Germany | 206/449 |
| 319103 | 11/1902 | France | 206/425 |
| 1016541 | 8/1952 | France | 220/22.3 |
| 1077091 | 4/1954 | France | 220/22.3 |
| 431269 | 2/1948 | Italy | 220/22 |
| 99953 | 11/1961 | Netherlands | 206/449 |
| 722347 | 1/1955 | United Kingdom | 220/22 |

*Primary Examiner*—William Price

*Attorney, Agent, or Firm*—Thomas R. Lampe

[57] ABSTRACT

A container for storing sheets of sandpaper including a housing, dividers within the housing forming a plurality of compartments, and a pair of moveable press plates disposed in the compartments to sandwich and compress the sandpaper sheets.

7 Claims, 2 Drawing Sheets

STORAGE DEVICE FOR SHEETS OF SANDPAPER

TECHNICAL FIELD

This invention relates to a device particularly adapted for storing sheets of sandpaper. The device constructed in accordance with the teachings of the present invention incorporates structure which cooperates to maintain sheets of sandpaper in good, flat, dry condition, even when the device is exposed to a hostile environment or jostled or oriented in different positions.

BACKGROUND ART

Painters, carpenters, and others using sandpaper sheets often have a difficult time maintaining a supply of such sheets in usable condition. This is especially true when the sheets are exposed to moisture or other hostile environments. A sandpaper sheet can become quite unusable when damp.

Curling of sandpaper sheets can also be a problem, even when the sheets are maintained relatively moisture free. Curled sandpaper sheets are, at the very least, extremely inconvenient to use and it is not at all unusual for curled sheets to be thrown away and not used.

DISCLOSURE OF THE INVENTION

The device of the present invention incorporates a housing including an end wall and a plurality of interconnecting side walls projecting from the end wall and defining an interior. Dividers project from at least some of the side walls and divide the interior into a plurality of compartments, each said compartment being of a size and configuration to accommodate therein a plurality of sandpaper sheets disposed in generally aligned, generally parallel relationship perpendicular to the end wall.

A pair of press plates are loosely disposed in at least one of the compartments generally perpendicular to the end wall. The press plates have height and width generally corresponding to the height and width of the sandpaper sheets and each press plate of each pair of press plates in a compartment is positionable against the outermost sheet of the plurality of sandpaper sheets in that compartment.

Finally, the device constructed in accordance with the teachings of the present invention includes a cover attachable to the housing to isolate the interior thereof from ambient conditions. The cover, the housing, and the dividers cooperate with the press plates to maintain the press plates generally perpendicular to the end wall and restrict movement of the press plates to directions generally parallel to the end wall.

The press plates, being freely moveable within their associated compartments cooperate to compress the sandpaper sheets disposed therebetween. The device can be at rest in any position and the plates of each of said pair of plates will move relative to one another and to the housing and cover to insure that the sandpaper sheets do not curl.

Other features, advantages, and objects of the present invention will become apparent with reference to the following detailed description and accompanying drawings.

BEST MODE FOR CARRYING OUT THE INVENTION

Figure 1:
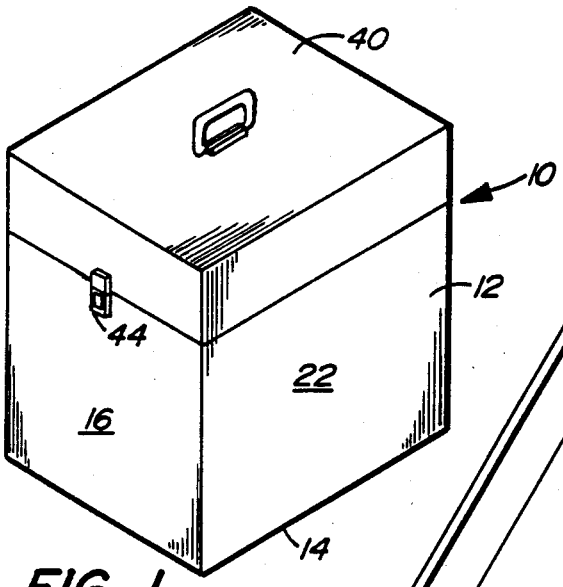
FIG. 1 is a perspective view of a preferred form of device constructed in accordance with the teachings of the present invention in closed condition.

Referring now to FIGS. 1–4, a device constructed in accordance with the teachings of the present invention, is generally designated by reference numeral 10. The container includes a housing 12, including an end wall 14 and a plurality of interconnecting side walls 16, 18, 20, 22, projecting from the end wall and defining an interior 24.

Figure 2:
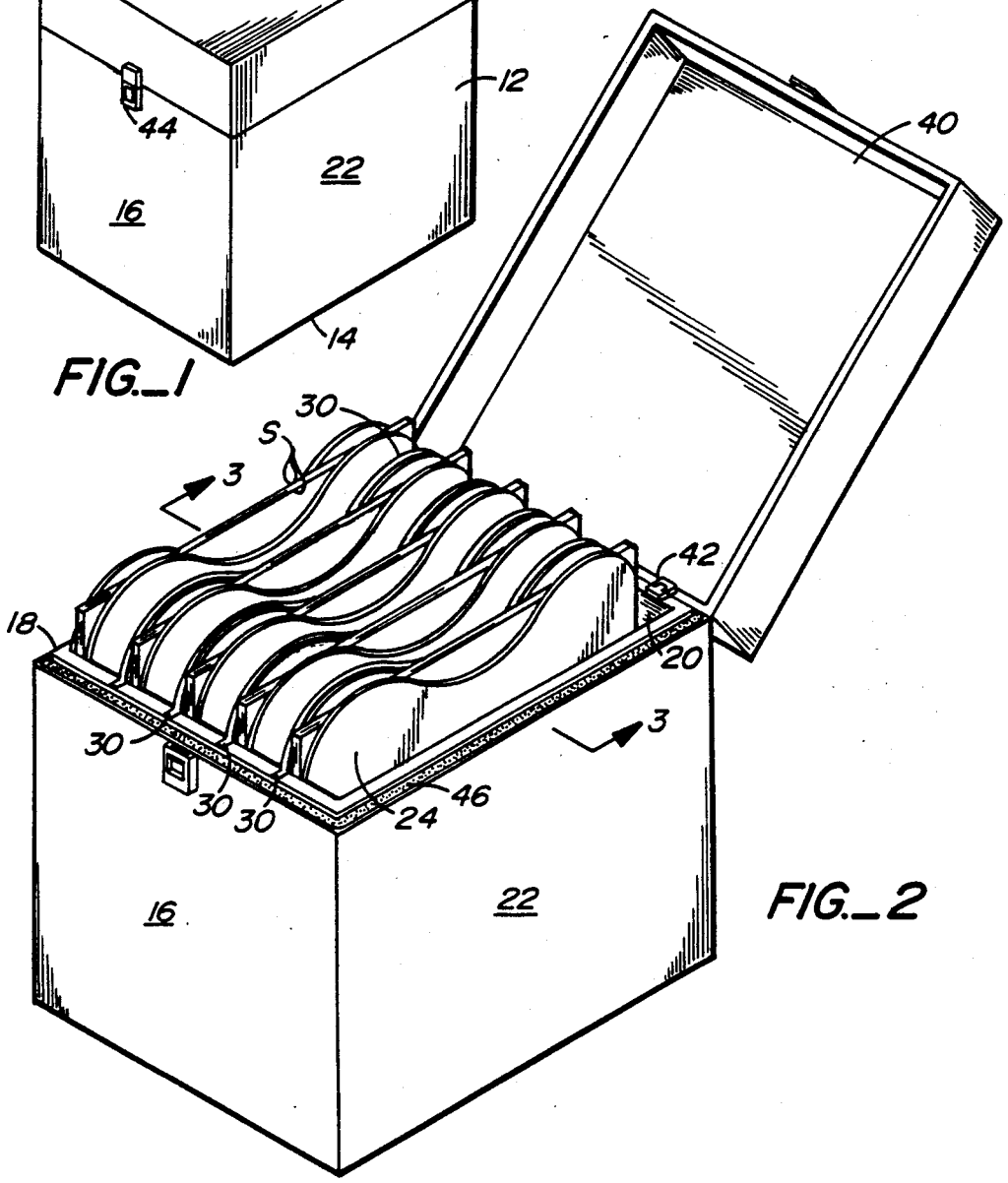
FIG. 2 is a perspective view of the device in open condition.
Figure 3:
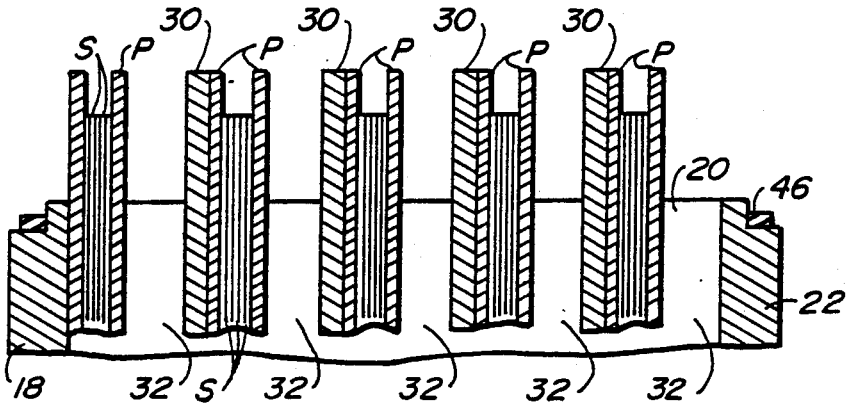
FIG. 3 is an enlarged, partial sectional view taken along line 3—3 in FIG. 2.

As may perhaps best be seen with reference to FIGS. 2 and 3, dividers 30 project from and extend between side walls 16, 20. The dividers 30 divide the interior 24 of housing 12 into a plurality of compartments 32. Each of the compartments 32 are of a size and configuration to accommodate therein a plurality of sandpaper sheets S disposed in generally aligned, generally parallel relationship perpendicular to end wall 14. In other words, when the end wall 14 is disposed at the bottom of the housing, the sandpaper sheets S are positioned on edge.

The distance between side walls 16, 20 is slightly greater than the width of the sandpaper sheets whereby the sheets S are loosely positioned within the housing and cannot engage both side walls 16, 20 at the same time.

An important aspect of the present invention resides in the use of a pair of press plates P in each of the compartments 32. Each press plate is generally perpendicular to the end wall and have a height and width generally corresponding to the height and width of the sandpapers sheets. In other words, the side edges of the press plates cannot engage both of side walls 16, 20 at the same time. Each press plate of each pair of press plates P in a compartment is positioned against the outermost sheet of a plurality of sandpaper sheets S disposed in that compartment. In other words, the press plates disposed in each compartment sandwich therebetween the sandpaper sheets in that compartment.

A cover 40 is positionable over the housing interior to isolate the interior from ambient conditions. In the arrangement shown, the cover 40 is attached to the housing by hinge means 42. Suitable latch means 44 serves to lock the cover in position over the housing interior. Preferably, a seal or gasket 46 is disposed between the housing and cover to maintain the interior as a generally fluid-tight compartment.

It will be appreciated that when the cover is closed, the cover, the housing, and dividers 30 cooperate with press plates P to maintain the press plates generally perpendicular to the end wall and restrict movement of the press plates in a direction generally parallel to the end wall. The press plates themselves are formed of any relatively heavy material, such as metal. The heavy press plates obviously serve to maintain the sandpaper sheets compressed therebetween regardless of the disposition or positioning of the device 10. Thus, the user of the device need not concern himself or herself with maintaining the device in a particular orientation.

Figure 4:
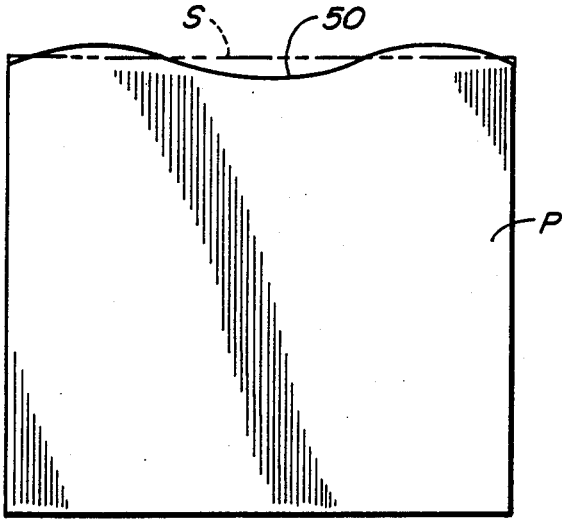
FIG. 4 is a plan view of a press plate of the type employed in the device.

It should be noted that the press plates P each define an indent 50 at the upper end thereof. The indents 50 allow exposure of the outermost sheets in a plurality of sheets disposed between each pair of end plates, thus facilitating the manual grasping thereof when the cover is opened and the housing interior is exposed. This is shown in FIG. 4 wherein a sheet of sandpaper S is shown in dash line. Except for the indent, the press plates P generally correspond to the size of the sheets S so that curling thereof is resisted. In the embodiment of the device shown in FIGS. 1–4, the dividers 30 are configured similarly to press plates P.

The housing 12 and cover 40 may be constructed of any suitable material. For example, the housing and cover could be formed of injected molded plastic. In any event, the components of the container should be resistent to chemicals such as acetone or other strong solvents, the types of materials often found in a work place where sandpaper is employed.

Figure 5:
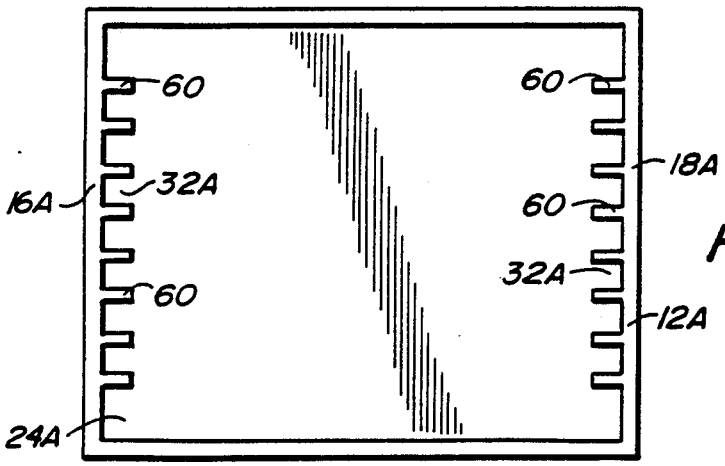
FIG. 5 is a plan view of a housing employed in an alternative form of device.

Rather than be solid members extending completely between side walls 16, 20, the dividers may take the form of tabs. FIG. 5 shows such an arrangement wherein each divider comprises tabs 60 integrally formed with side walls 16A, 20A. The tabs 60 on the side walls 16A, 20A are directly opposite one another and divide interior 24A of housing 12A into a plurality of compartments 32A between each opposed set of tabs.

I claim:

1. A device for storing sheets of sandpaper having a predetermined length and width, said device comprising, in combination:

a housing including an end wall and a plurality of interconnecting side walls projecting from said end wall and defining an interior;

dividers projecting from at least some of said side walls and dividing said interior into a plurality of compartments, each said compartment being of a size and configuration to accommodate therein a plurality of sandpaper sheets disposed in generally aligned, generally parallel relationship perpendicular to said end wall;

a pair of press plates loosely disposed in at least one of said compartments generally perpendicular to said end wall, said press plates having height and width generally corresponding to the height and width of said sandpaper sheets and each press plate of said pair of press plates in a compartment positionable against the outermost sheet of the plurality of sandpaper sheets in said compartment; and a cover attachable to said housing to isolate said interior from ambient conditions, said cover, said housing, and said dividers cooperating with said press plates to maintain said press plates generally perpendicular to said end wall and restrict movement of said press plates to directions generally parallel to said end wall.

2. The device according to claim 1 wherein said press plates are discrete, flat, detached plates.

3. The device according to claim 2 wherein said press plates are metal plates.

4. The device according to claim 1 wherein said dividers ar tabs projecting from opposed side walls.

5. The device according to claim 1 wherein at least some of said press plates define an indent at a location thereon remote from said end wall to facilitate manual grasping of sandpaper sheet and removal thereof from said interior.

6. A storage device for sandpaper sheets, said device comprising:

a housing having a pair of opposed side walls and an end wall, said side walls and end wall defining an interior;

a plurality of sandpaper sheets disposed in generally parallel relationship and positioned on edge on said end wall when said container is oriented with said end wall lowermost; and spaced press plates generally parallel to said sandpaper sheets and disposed on opposed sides of said plurality of sandpaper sheets, said press plates being detached and movable within said interior under the influence of gravity when said storage device is reoriented to compress said sandpaper sheets and maintain said sandpaper sheets in a flattened condition.

7. The storage device of claim 6 additionally comprising dividers projecting from opposed side walls and dividing said interior into a plurality of compartments, each said compartment adapted to accommodate a pair of press plates disposed on opposed sides of sandpaper sheets located in said compartment.

* * * * *